US010751736B2

(12) United States Patent
Sato

(10) Patent No.: US 10,751,736 B2
(45) Date of Patent: Aug. 25, 2020

(54) CLEANING APPARATUS, SPHERICAL OBJECT CLEANING SYSTEM, AND METHOD FOR CLEANING SPHERICAL OBJECT

(71) Applicant: NTN CORPORATION, Osaka-shi, Osaka (JP)

(72) Inventor: Norihide Sato, Mie (JP)

(73) Assignee: NTN CORPORATION, Osaka (JP)

( * ) Notice: Subject to any disclaimer, the term of this patent is extended or adjusted under 35 U.S.C. 154(b) by 195 days.

(21) Appl. No.: 15/771,743

(22) PCT Filed: Oct. 19, 2016

(86) PCT No.: PCT/JP2016/080969

§ 371 (c)(1),
(2) Date: Apr. 27, 2018

(87) PCT Pub. No.: WO2017/073431

PCT Pub. Date: May 4, 2017

(65) Prior Publication Data

US 2018/0311683 A1 Nov. 1, 2018

(30) Foreign Application Priority Data

Oct. 29, 2015 (JP) ..... 2015-212850
Oct. 3, 2016 (JP) ..... 2016-195865

(51) Int. Cl.
*B08B 1/04* (2006.01)
*B05B 1/04* (2006.01)
(Continued)

(52) U.S. Cl.
CPC ..... *B05B 1/04* (2013.01); *B08B 1/006* (2013.01); *B08B 1/02* (2013.01); *B08B 1/04* (2013.01); *B24B 11/06* (2013.01)

(58) Field of Classification Search
CPC .. B05B 1/04; B08B 1/006; B08B 1/02; B08B 1/04; B24B 11/06
(Continued)

(56) References Cited

U.S. PATENT DOCUMENTS 981,310 A * 1/1911 Ringland ..... B24B 11/06 451/284
1,176,099 A * 3/1916 Rockwell ..... B24B 11/06 451/284
(Continued)

FOREIGN PATENT DOCUMENTS

DE 2262292 A1 6/1974
DE 4032372 A1 4/1992
(Continued)

OTHER PUBLICATIONS

Extended European Search Report issued in corresponding European Patent Application No. 16859661.7, dated May 20, 2019.
(Continued)

*Primary Examiner* — Weilun Lo
(74) *Attorney, Agent, or Firm* — McDermott Will & Emery LLP

(57) ABSTRACT

A spherical object cleaning system includes a cleaning apparatus for cleaning a spherical object. This cleaning apparatus includes a first member having a first surface, and a second member having a second surface facing the first surface. The first surface and the second surface are sandwiching surfaces sandwiching the spherical object. The first surface and the second surface are configured to be rotatable relative to each other. This cleaning apparatus further includes an introduction portion configured to introduce the spherical object into a space between the first surface and the second surface, and a discharge portion configured to discharge the spherical object from the space. One of the first surface and the second surface is provided with a spiral
(Continued)

groove configured to guide the spherical object from the introduction portion to the discharge portion.

11 Claims, 8 Drawing Sheets

(51) Int. Cl.
*B08B 1/02* (2006.01)
*B08B 1/00* (2006.01)
*B24B 11/06* (2006.01)

(58) Field of Classification Search
USPC ..... 15/97.1
See application file for complete search history.

(56) References Cited

U.S. PATENT DOCUMENTS 1,516,749 A 11/1924 Moore et al.
1,527,092 A * 2/1925 Stewart ..... B24B 11/06 451/284
4,370,772 A * 2/1983 Gustafsson ..... B08B 3/04 15/97.1
5,546,629 A * 8/1996 Shim ..... A63B 47/04 15/302
5,819,351 A * 10/1998 Porper ..... A63B 47/04 15/21.2
9,089,947 B2 * 7/2015 Tanaka ..... B24B 11/06
2005/0266230 A1 12/2005 Hill et al.
2015/0231754 A1 * 8/2015 Hayakawa ..... B21K 1/02 451/177

FOREIGN PATENT DOCUMENTS

GB 1432960 A 4/1976
GB 1434637 A 5/1976
JP 45-11920 Y1 5/1970
JP 55-501173 A 12/1980
JP H06-319866 A 11/1994
JP 07-100229 A 4/1995
JP 3472730 B2 12/2003
WO 80/01664 A1 8/1980

OTHER PUBLICATIONS

International Search Report issued in corresponding PCT/JP2016/080969, dated Jan. 24, 2017.

* cited by examiner

CLEANING APPARATUS, SPHERICAL OBJECT CLEANING SYSTEM, AND METHOD FOR CLEANING SPHERICAL OBJECT

RELATED APPLICATIONS

This application is a national stage of International Application No. PCT/JP2016/080969, filed Oct. 19, 2016, which claims the benefit of Japanese Application No. 2015-212850, filed on Oct. 29, 2015, and Application No. 2016-195865, filed Oct. 3, 2016, the disclosures of which are incorporated in their entirety by reference herein.

TECHNICAL FIELD

The present invention relates to a cleaning apparatus, a spherical object cleaning system, and a method for cleaning a spherical object. Particularly, the present invention relates to a cleaning apparatus, a spherical object cleaning system, and a method for cleaning a spherical object that allow uniform cleaning of a surface of a spherical object.

BACKGROUND ART

A steel ball or a ceramic ball for a bearing is subjected to precise polishing processing in order to obtain a high degree of sphericity. In this polishing processing, the spherical object is polished using a grindstone or free abrasive grains and an oil-based or water-based coolant. Therefore, contamination such as coolant or polishing powder may in some cases adhere to a surface of the spherical object subjected to polishing processing, and thus, it is necessary to further perform a cleaning step in order to remove the contamination.

A method for cleaning a spherical object includes various methods depending on a size of the spherical object and the required degree of cleanliness. Examples of a general method for cleaning a spherical object include ultrasonic cleaning, brush cleaning, roll cleaning, hand-wash cleaning or the like. In the case of ultrasonic cleaning, a spherical object is cleaned by a shock wave generated by cavitation. In the case of brush cleaning, a spherical object is put into a disk-shaped cage and a surface of the spherical object is rubbed with a brush to thereby clean the spherical object. In the case of roil cleaning, a spherical object is rolled on a sponge or the like to thereby clean the spherical object. In the case of hand-wash cleaning, a spherical object is rolled with double-handed kneading or with a sponge and a hand to thereby clean the spherical object. In addition, as this type of method for cleaning a spherical object, Japanese Patent Laying-Open No. 7-100229 (PTD 1) describes a method for cleaning a spherical object while feeding the spherical object along a spiral guide member.

CITATION LIST

Patent Document

PTD 1: Japanese Patent Laying-Open No. 7-100229

SUMMARY OF INVENTION

Technical Problem

In a step of cleaning a steel ball or a ceramic ball subjected to polishing processing, it is necessary to ensure the uniform and high degree of cleanliness on an entire surface of the spherical object and suppress the occurrence of a flaw caused by collision and contact between the spherical objects during the cleaning work. However, a conventional cleaning method has had difficulty in cleaning a surface of a spherical object with the uniform and high degree of cleanliness.

The present invention has been made in view of the above-described problem and an object of the present invention is to provide a cleaning apparatus, a spherical object cleaning system, and a method for cleaning a spherical object that allow uniform cleaning of a surface of a spherical object.

Solution to Problem

A cleaning apparatus according to the present invention is a cleaning apparatus for cleaning a spherical object. The cleaning apparatus includes: a first member having a first surface; and a second member having a second surface facing the first surface. The first surface and the second surface are sandwiching surfaces sandwiching the spherical object. The first surface and the second surface are configured to be rotatable relative to each other. The cleaning apparatus further includes: an introduction portion configured to introduce the spherical object into a space between the first surface and the second surface; and a discharge portion configured to discharge the spherical object from the space. One of the first surface and the second surface is provided with a spiral groove configured to guide the spherical object from the introduction portion to the discharge portion.

In the cleaning apparatus according to the present invention, with the spherical object sandwiched between the first surface and the second surface, the first surface and the second surface are rotated relative to each other, and the spherical object can thereby be rotated. The rotating spherical object is guided along the spiral groove from the introduction portion to the discharge portion and cleaned, and thus, it is possible to clean a surface of the spherical object while changing an inclination of a rotation axis with respect to the sandwiching surfaces (first and second surfaces). As a result, a more uniform degree of cleanliness can be ensured on the entire surface of the spherical object. Therefore, according to the cleaning apparatus in the present invention, there can be provided a cleaning apparatus that allows uniform cleaning of a surface of a spherical object.

Preferably, in the cleaning apparatus, one of the first member and the second member is a deformation member configured such that the sandwiching surface can deform from a flat surface to a curved surface conforming to a shape of a surface of the spherical object.

With the above-described configuration, a differential slip occurs in contact portions between the spherical object and the sandwiching surfaces, and thus, it is possible to clean the surface of the rotating spherical object while rubbing the surface of the rotating spherical object against the sandwiching surfaces. As a result, the surface of the spherical object can be cleaned more uniformly.

Preferably, in the cleaning apparatus, the deformation member includes: a porous member; and a fibrous member arranged on the porous member, forming the sandwiching surface, and impregnated with a cleaning agent for cleaning the spherical object.

With the above-described configuration, the porous member is used, and thus, the flexibility of the deformation member can be ensured, in addition, the spherical object is held on the fibrous member impregnated with the cleaning agent, and thus, a high cleaning effect can be obtained. As a result, a higher degree of cleanliness can be ensured on the surface of the spherical object.

Preferably, in the cleaning apparatus, the cleaning agent includes an organic solvent or water. In this way, in the cleaning apparatus, the cleaning agent suitable for cleaning of the surface of the spherical object can be selected as appropriate.

Preferably, in the cleaning apparatus, the spiral groove is a region enclosed by the one of the first surface and the second surface and a wall surface of a wall portion protruding from the one of the first surface and the second surface toward the other of the first surface and the second surface. The first and second surfaces forming the space as well as the wall surface in the space are formed of a porous member.

With the above-described configuration, when the spherical object, the surface of which a bond with abrasive grains has adhered to during polishing processing, is cleaned by the cleaning apparatus, the bond with abrasive grains is taken into pores included in the porous member. Therefore, the trouble of occurrence of a flaw on the surface of the spherical object caused by the bond with abrasive grains can be suppressed.

Preferably, in the cleaning apparatus, the spiral groove is a region enclosed by the one of the first surface and the second surface and a wall surface of a wail portion protruding from the one of the first surface and the second surface toward the other of the first surface and the second surface. The wall surface is a surface having a friction coefficient higher than that of the one of the first surface and the second surface.

With the above-described configuration, when the spherical object transported along the spiral groove, with the spherical object sandwiched between the sandwiching surfaces (first and second surfaces), comes into contact with the wall surface, the rotation axis of the spherical object can be changed due to a difference in friction coefficient between the sandwiching surface and the wall surface. As a result, the surface of the spherical object can be cleaned further uniformly.

Preferably, in the cleaning apparatus, the spiral groove includes a portion having a path changed from a spiral path.

With the above-described configuration, the rotation axis of spherical object. can be changed in the portion having the changed path. As a result, the surface of the spherical object can be cleaned further uniformly.

Preferably, in the cleaning apparatus, the first member and the second member are arranged such that rotation axes are eccentric to each other.

With the above-described configuration, the rotation axis of the spherical object can be changed due to a difference in circumferential speed when the first member and the second member are rotated relatively. As a result, the surface of the spherical object can be cleaned further uniformly.

Preferably, in the cleaning apparatus, a member provided with the spiral groove, of the first member and the second member, includes a resin material or a metal material. In this way, the constituent material of the member provided with the spiral groove can be selected as appropriate in consideration of ingredients of the cleaning agent and the like.

Preferably, a spherical object cleaning system including the cleaning apparatus includes a plurality of the cleaning apparatuses. Preferably, the spherical object cleaning system further includes transport means configured to transport the spherical object cleaned by one of the plurality of cleaning apparatuses to another cleaning apparatus located on a downstream side of the one of the plurality of cleaning apparatuses. With the above-described configuration, the plurality of cleaning apparatuses are used, and thus, the surface of the spherical object can be cleaned further uniformly.

A method for cleaning a spherical object according to the present invention includes: preparing a spherical object; and preparing a cleaning apparatus for cleaning the spherical object. The cleaning apparatus includes: a first member having a first surface; a second member having a second surface facing the first surface; an introduction portion configured to introduce the spherical object into a space between the first surface and the second surface; and a discharge portion configured to discharge the spherical object from the space. One of the first surface and the second surface is provided with a spiral groove configured to guide the spherical object from the introduction portion to the discharge portion. The method for cleaning the spherical object further includes: introducing the spherical object from the introduction portion into the space; cleaning the spherical object in the space; and discharging the cleaned spherical object from the discharge portion. In cleaning the spherical object, with the spherical object sandwiched between the first surface and the second surface, the first surface and the second surface are rotated relative to each other, to thereby rotate the spherical object, and the rotating spherical object is guided in the spiral groove from the introduction portion to the discharge portion and cleaned.

In the method for cleaning the spherical object according to the present invention, with the spherical object sandwiched between the first surface and the second surface, the first surface and the second surface are rotated relative to each other, and the spherical object can thereby be rotated. The rotating spherical object is guided in the spiral groove from the introduction portion to the discharge portion and cleaned, and thus, it is possible to clean a surface of the spherical object while changing an inclination of a rotation axis with respect to the sandwiching surfaces (first and second surfaces). As a result, a more uniform degree of cleanliness can be ensured on the entire surface of the spherical object. Therefore, according to the method for cleaning the spherical object in the present invention, there can be provided a method for cleaning a spherical object that allows uniform cleaning of a surface of a spherical object.

ADVANTAGEOUS EFFECTS OF INVENTION

As is clear from the description above, according to the cleaning apparatus, the spherical object cleaning system, and the method for cleaning the spherical object in the present invention, there can be provided a cleaning apparatus, a spherical object cleaning system, and a method for cleaning a spherical object that allow uniform cleaning of a surface of a spherical object.

DESCRIPTION OF EMBODIMENTS

Embodiments of the present invention will be described hereinafter with reference to the drawings.

First Embodiment (Configuration of Spherical Object Cleaning System)

First, a configuration of a spherical object cleaning system according to a first embodiment which is one embodiment of the present invention will be described with reference to FIGS. 1 to 3. A spherical object cleaning system 1 according to the present embodiment includes a cleaning apparatus 10 for cleaning a spherical object 30.

Spherical object 30 may be, for example, a steel ball or a ceramics ball such as a nitrogen silicon ball for a bearing, or may be another spherical object. Although FIG. 1 shows the case in which spherical object cleaning system 1 includes one cleaning apparatus 10, the spherical object cleaning system in the present invention may include a plurality of cleaning apparatuses as described in the other embodiments below.

Figure 3:
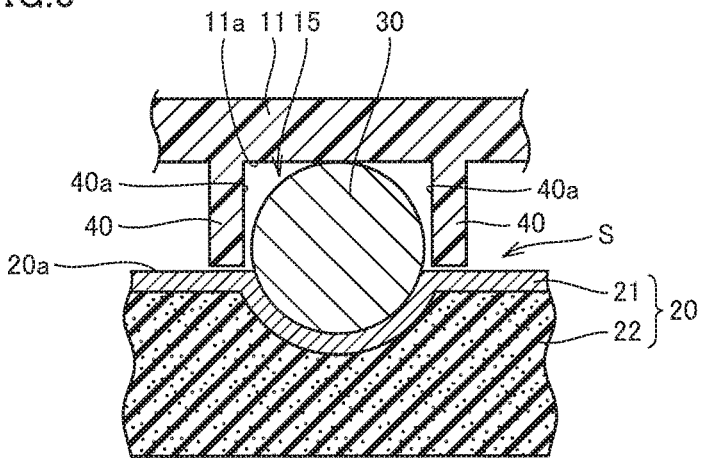
FIG. 3 is a schematic view showing a cross-sectional structure taken along line III-III in FIG. 2.

Referring to FIG. 3, cleaning apparatus 10 includes a spiral groove disk 11 as a first member having a first surface 11*a*, and a flat disk 20 as a second member having a second surface 20*a* facing first surface 11*a*. First surface 11*a* and second surface 20*a* are sandwiching surfaces sandwiching spherical object 30.

First surface 11*a* and second surface 20*a* are configured to be rotatable relative to each other. That is, first surface 11*a* and second surface 20*a* may be configured such that first surface 11*a* is fixed and second surface 20*a* is rotatable, or such that second surface 20*a* is fixed and first surface 11*a* is rotatable, or such that both first surface 11*a* and second surface 20*a* are rotatable.

Figure 1:
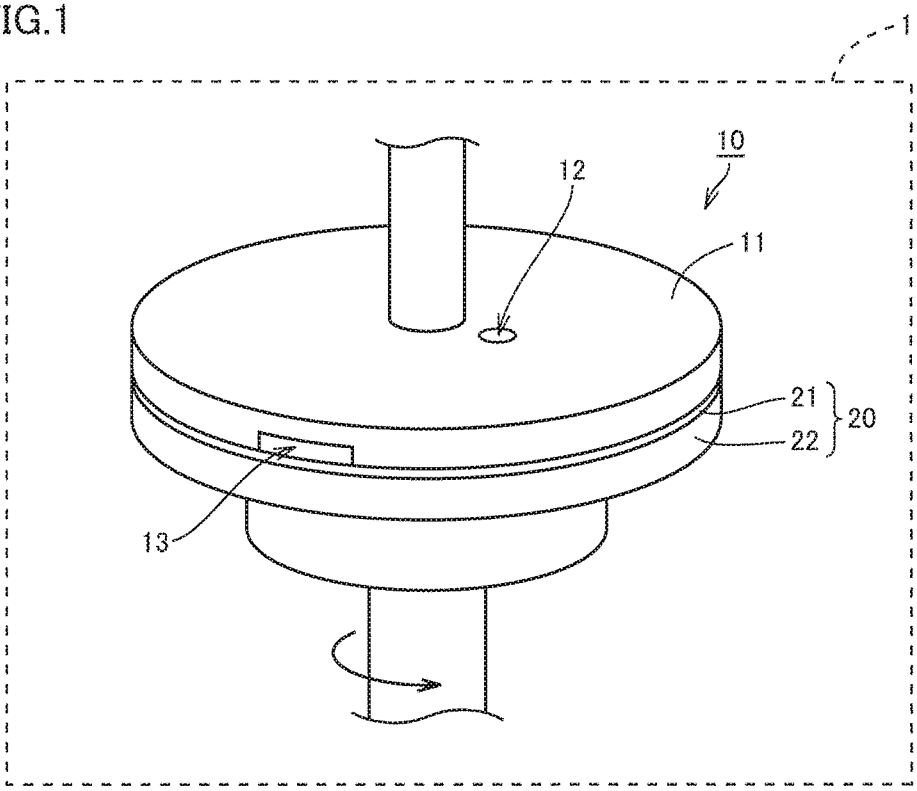
FIG. 1 is a perspective view schematically showing a configuration of a spherical object cleaning system according to a first embodiment of the present invention.
Figure 2:
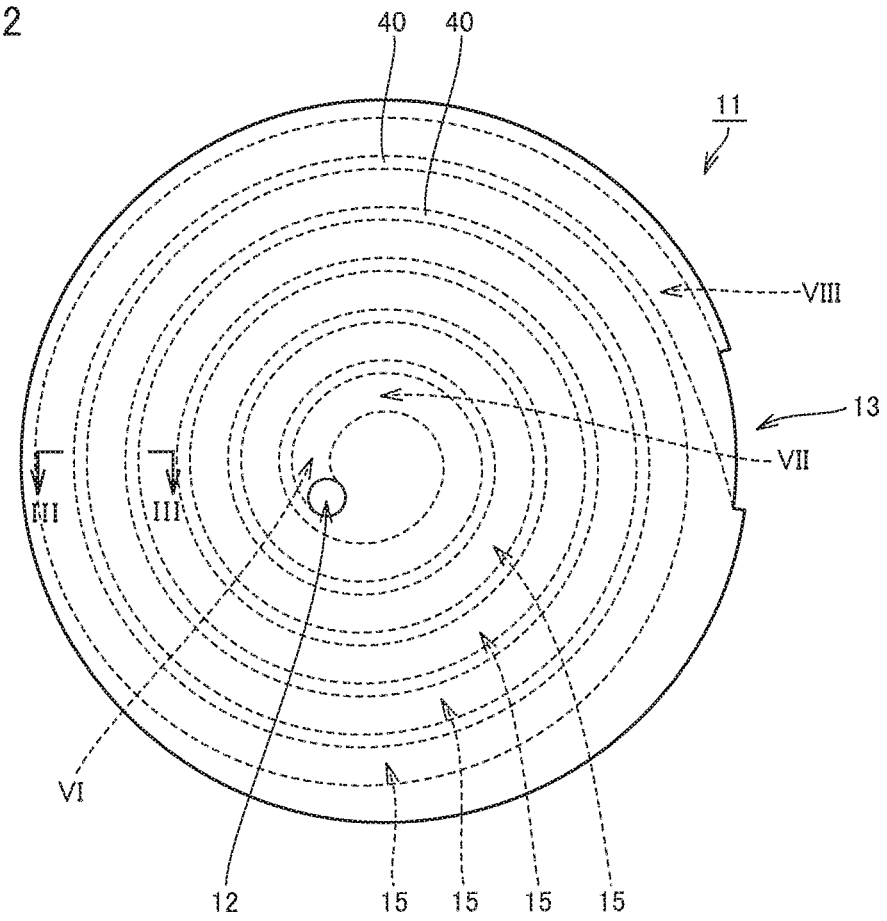
FIG. 2 is a plan view schematically showing a first example of the configuration of the spherical object cleaning system according to the first embodiment of the present invention.

Referring to FIGS. 1 to 3, cleaning apparatus 10 includes an introduction portion 12 configured to introduce spherical object 30 into a space S between first surface 11*a* and second surface 20*a*, and a discharge portion 13 configured to discharge spherical object 30 from space S. Introduction portion 12 may be provided in a central portion of spiral groove disk 11, and discharge portion 13 may be provided in a part of an outer circumferential surface of spiral groove disk 11.

Referring to FIG. 2, spiral groove disk 11 has a circular shape in a plan view, and spherical object 30 is arranged in a spiral groove 15 having a substantially circular spiral shape in a plan view. Referring to FIGS. 2 and 3, spiral groove 15 is a portion for guiding spherical object 30 from introduction portion 12 to discharge portion 13. Spiral groove 15 may be, for example, an Archimedes' spiral, or may be a Bernoulli's spiral. However, spiral groove 15 is not limited to such a groove having a regular shape. With the above-described configuration, spiral groove 15 can guide spherical object 30 introduced from introduction portion 12 into space S to discharge portion 13 along spiral groove 15, and discharge cleaned spherical object 30 to the outside of cleaning apparatus 10 through discharge portion 13. Spiral groove 15 may only be provided in one of first surface 11*a* and second surface 20*a*, and may be provided in second surface 20*a*. A direction of spiral groove 15 may be a clockwise direction as viewed two-dimensionally from above spiral groove disk 11 as shown in FIG. 2, or may be a counterclockwise direction.

Spiral groove disk 11 as the first member, which is a member provided with spiral groove 15, includes a resin material or a metal material, and preferably includes a resin material, More specifically, the material of spiral groove disk 11 can be selected as appropriate in consideration of ingredients of a cleaning agent, and spiral groove disk 11 is made of, for example, poly vinyl chloride (PVC). Thus, swelling of spiral groove disk 11 can be suppressed even in the case of using an oil-based or water-based cleaning agent. In addition, in the case of a spiral groove disk made of metal, the metal may in some cases rub against and adhere to a surface of a ceramic ball. However, spiral groove disk 11 made of PVC can suppress this.

Referring to FIG. 3, spiral groove 15 is a region enclosed by first surface 11*a* and a wall surface 40*a*. Wall surface 40*a* is included in a wall portion 40 protruding from first surface 11*a* toward second surface 20*a*. Wall surface 40*a* may be a surface having a friction coefficient higher than that of first surface 11*a*. As a result, when spherical object 30 comes into contact with wail surface 40*a*, a rotation axis of spherical object 30 can be changed due to a difference in friction coefficient between wall surface 40*a* and first surface 11*a*, and thus, a surface of spherical object 30 can be cleaned more uniformly. Examples of a method for making the friction coefficient of wall surface 40*a* higher than the friction coefficient of first surface 11*a* include a method for performing roughening processing on wall surface 40*a*, a method for providing a coating layer on wall surface 40*a*, and the like, Flat disk 20 as the second member is a deformation member configured such that second surface 20*a* which is the sandwiching surface can deform from a flat surface to a curved surface conforming to a shape of the surface of spherical object 30. Flat disk 20 which is the deformation member includes a porous member 22 and a fibrous member 21 arranged on porous member 22.

Porous member 22 is an elastic member such as, for example, a sponge. Fibrous member 21 thrms second surface 20*a* which is the sandwiching surface. Fibrous member 21 is fabric (e.g., non-woven fabric) and is impregnated with a cleaning agent for cleaning spherical object 30. The cleaning agent includes an organic solvent or water, and is white kerosene, for example.

Flat disk 20 which is the deformation member may be formed only by porous member 22 without fibrous member 21. However, provision of fibrous member 21 makes it possible to further improve the effect of cleaning spherical object 30. The present invention is not limited to the case in which flat disk 20 is the deformation member, and spiral groove disk 11 provided with spiral groove 15 may be formed as the above-described deformation member.

Figure 4:
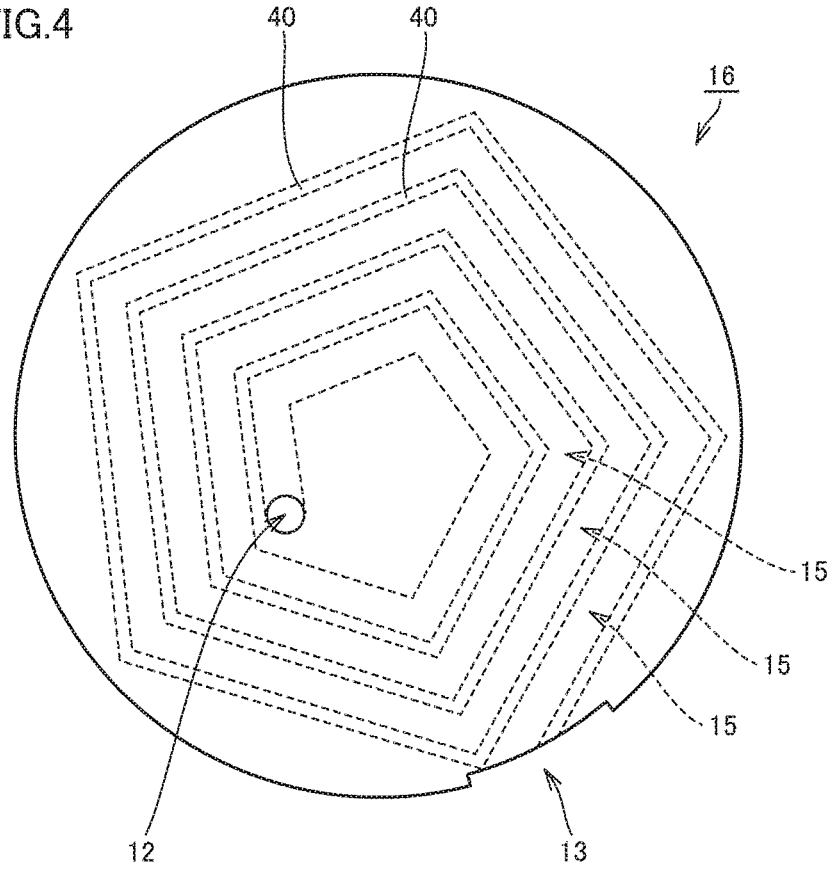
FIG. 4 is a plan view schematically showing a second example of the configuration of the spherical object cleaning system according to the first embodiment of the present invention.

Referring to FIG. 4, a spiral groove disk 16 is configured to have spiral groove 15 having a substantially polygonal (pentagonal) spiral shape in a plan view. Although spiral groove disk 16 in FIG. 4 is different from spiral groove disk 11 in FIG. 2 in this respect, spiral groove disk 16 in FIG. 4 is otherwise identical to spiral groove disk 11 in FIG. 2 and a cross-sectional structure is basically identical to the cross-sectional structure shown in FIG. 3. Therefore, detailed description about spiral groove disk 16 in FIG. 4 will not be repeated.

(Method for Cleaning Spherical Object)

Figure 5:
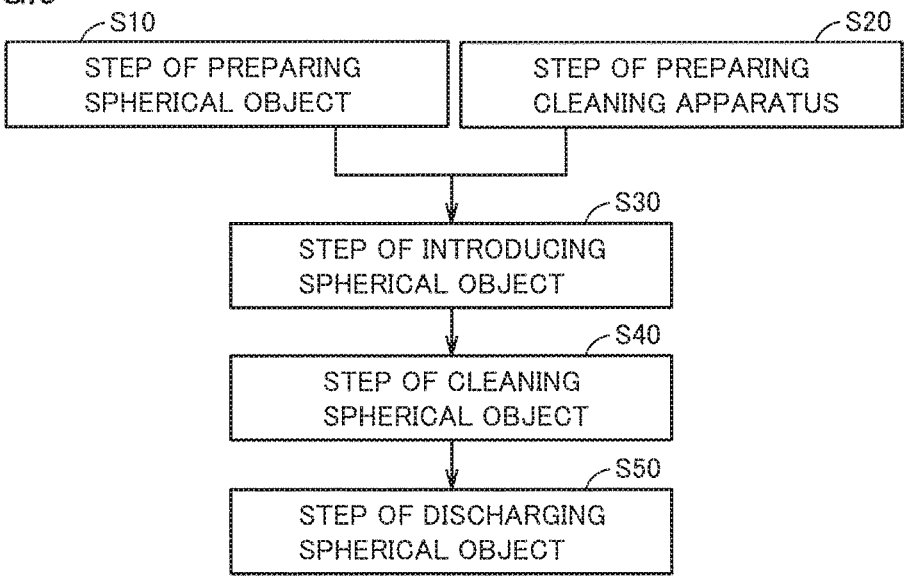
FIG. 5 is a flowchart schematically showing a method for cleaning a spherical object according to the first embodiment of the present invention.

Next, a method for cleaning a spherical object according to the present embodiment performed using spherical object cleaning system 1 described above will be described. Referring to FIG. 5, first, as a step (S10), a step of preparing a spherical object is performed. In this step (S10), spherical object 30 such as a steel ball or a ceramic bail for a bearing subjected to precise polishing processing is prepared. In parallel with this step (S10), a step (S20) of preparing a cleaning apparatus for cleaning spherical object 30 is performed. In this step (S20), cleaning apparatus 10 of spherical object cleaning system 1 according to the present embodiment described above is prepared.

Next, as a step (S30), a step of introducing spherical object 30 from introduction portion 12 into space S is performed. In this step (S30), spherical object 30 may be continuously introduced at an interval of, for example, 0.5 seconds in order to suppress collision and contact between spherical objects 30. That is, in spherical object. cleaning system 1 described above, spiral groove 15 is provided in a plane of first surface 11*a,* and thus, collision and contact between spherical objects 30 can be suppressed by adjusting the interval of introduction of spherical object 30.

Next, as a step (S40), a step of cleaning spherical object 30 in space S is performed. In this step (S40), referring to FIGS. 2 and 3, with spherical object 30 sandwiched between first surface 11*a* and second surface 20*a*, first surface 11*a* and second surface 20*a* are rotated relative to each other, to thereby rotate spherical object 30. At this time, first surface 11*a* may be fixed and only second surface 20*a* may be rotated, or second surface 20*a* may be fixed and only first surface 11*a* may be rotated, or both first surface 11*a* and second surface 20*a* may be rotated. Rotating spherical object 30 is guided in spiral groove 15 from introduction portion 12 to discharge portion 13 and cleaned. At this time, spherical object 30 is transported along a spiral path of spiral groove 15, and thus, an inclination of the rotation axis with respect to the sandwiching surfaces (first surface 11*a* and second surface 20*a*) changes. Spherical object 30 may be wet-cleaned with white kerosene with which fibrous member 21 is impregnated, or may be dry-cleaned by blowing gas onto the surface of spherical objet 30.

Figure 6:
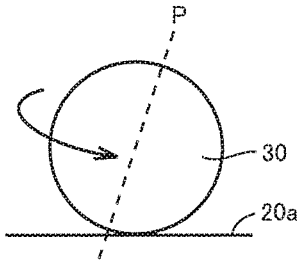
FIG. 6 is a schematic view showing an inclination of a rotation axis of the spherical object in a region VI in FIG. 2.
Figure 7:
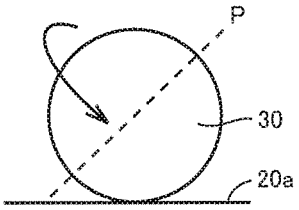
FIG. 7 is a schematic view showing an inclination of the rotation axis of the spherical object in a region VII in FIG. 2.
Figure 8:
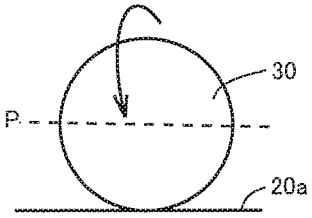
FIG. 8 is a schematic view showing an inclination of the rotation axis of the spherical object in a region VIII in FIG. 2.

Now, a change in inclination of the rotation axis of spherical object 30 transported along spiral groove 15 will be described with reference to FIGS. 6 to 8. FIG. 6 shows an inclination of a rotation axis P of spherical object 30 in a region VI in FIG. 2. FIG. 7 shows an inclination of rotation axis P of spherical object 30 in a region VII in FIG. 2. FIG. 8 shows an inclination of rotation axis P of spherical object 30 in a region VIII in FIG. 2. As described with reference to FIG. 3, second surface 20*a* which is one sandwiching surface deforms to a curved surface when holding spherical object 30, However, FIGS. 6 to 8 show second surface 20*a* in a flat surface state and show the inclination of rotation axis P of spherical object 30 with respect to second surface 20*a* in this state.

Rotation axis P of spherical object 30 immediately after introduction intersects with the sandwiching surface (second surface 20*a*) (FIG. 6), whereas rotation axis P of spherical object 30 immediately before discharge is substantially horizontal with respect to the sandwiching surface (second surface 20*a*) (FIG. 8). That is, as shown in FIGS. 6 to 8, an inclination angle with respect to the sandwiching surface changes to become gradually smaller in the process of transporting spherical object 30 introduced from introduction portion 12 to discharge portion 13 along spiral groove 15.

Particularly, in the case of using spiral groove disk 16 having polygonal spiral groove 15 as shown in FIG. 4, the inclination angle of rotation axis P of spherical object 30 can be changed when spherical object 30 passes through a corner portion of spiral groove 15 in a plan view.

Next, as a step (S50), a step of discharging cleaned spherical object 30 from discharge portion 13 is performed. The steps (S10) to (S50) described above are sequentially performed, and thus, cleaning of spherical object 30 ends and the method for cleaning the spherical object according to the present embodiment is completed.

As described above, in spherical object cleaning system 1 according to the present embodiment, with spherical object 30 sandwiched between first surface 11*a* and second surface 20*a*, first surface 11*a* and second surface 20*a* are rotated relative to each other, and thus, it is possible to clean spherical object 30 while rotating spherical object 30. Rotating spherical object 30 is guided in spiral groove 15 from introduction portion 12 to discharge portion 13 and cleaned, and thus, it is possible to clean the surface of spherical object 30 while changing the inclination of the rotation axis. As a result, a more uniform degree of cleanliness can be ensured on the entire surface of spherical object 30, and further, a higher degree of cleanliness can be obtained as compared with the case of ultrasonic cleaning, brush cleaning and the like. Therefore, according to spherical object cleaning system 1 and the method for cleaning the spherical object in the present embodiment, the surface of spherical object 30 can he cleaned uniformly. In addition, spherical object cleaning system 1 according to the present embodiment described above is applicable to cleaning of spherical objects 30 having various sizes, and can achieve power saving and space-saving placement.

Second Embodiment

Next, a second embodiment which is another embodiment of the present invention will be described. Basically, a spherical object cleaning system according to the second embodiment has a configuration similar to that of spherical object cleaning system 1 according to the first embodiment described above, and produces an effect similar to that of spherical object cleaning system 1 according to the first embodiment described above. However, the spherical object cleaning system according to the second embodiment is different from spherical object cleaning system 1 according to the first embodiment described above in terms of a configuration of a spiral groove.

Figure 9:
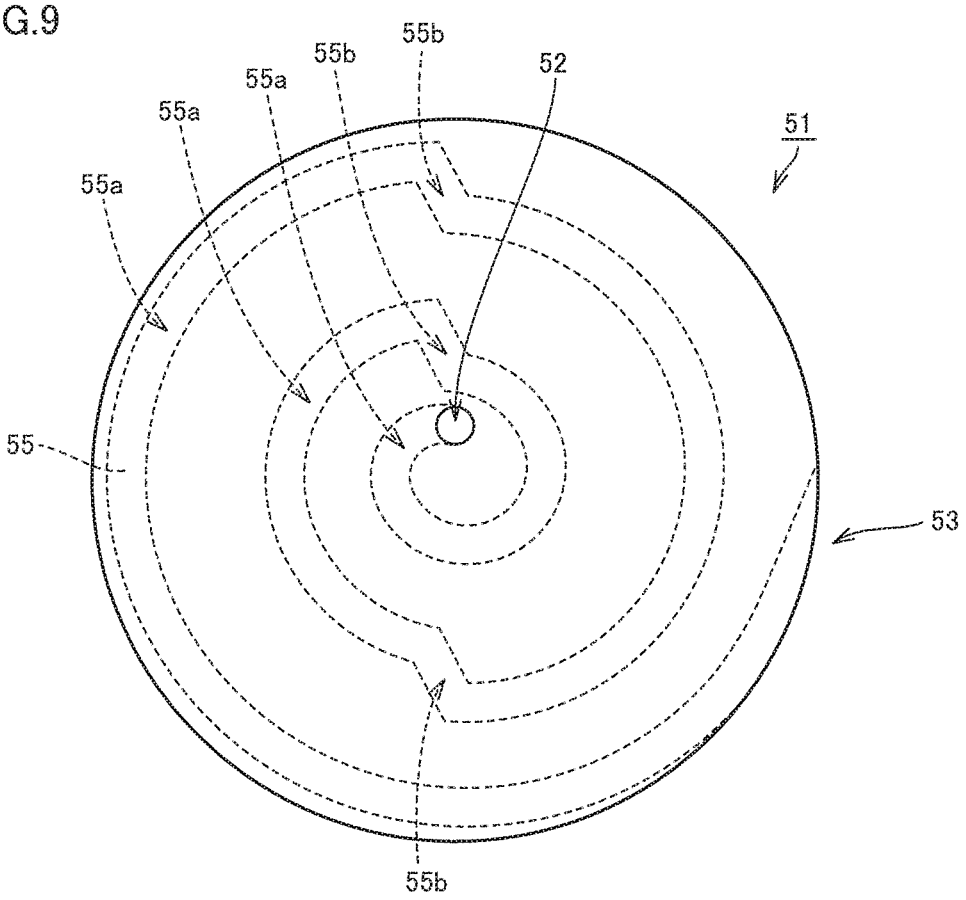
FIG. 9 is a plan view schematically showing a configuration of a spherical object cleaning system according to a second embodiment of the present invention.

Referring to FIG. 9, a spiral groove disk 51 as the first member is provided with a spiral groove 55 configured to guide spherical object 30 from an introduction portion 52 to a discharge portion 53. Spiral groove 55 includes a portion having a path changed from. a spiral path. More specifically, spiral groove 55 has spiral path portions 55*a*, and a plurality of (in FIG. 9, three) path changed portions 55*b* located between spiral path portions 55*a*. Path changed portion 55*b* is provided so as to extend in a direction intersecting with a tangential direction of spiral path portion 55*a*.

Figure 10:
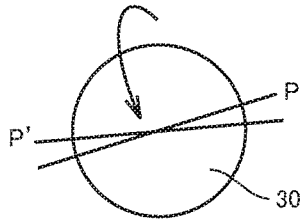
FIG. 10 is a schematic view showing a change in the rotation axis of the spherical object.

According to the spherical object cleaning system in the present embodiment described above, the rotation axis of spherical object 30 introduced from introduction portion 52 can be changed in path changed portion 55*b*. More specifically, as shown in FIG. 10, rotation axis P of spherical object 30 can be changed into a rotation axis P' when spherical object 30 passes through path changed portion 55*b*. As a result, the surface of spherical object 30 can be cleaned more uniformly. The position and the number of path changed portions 55*b* are not particularly limited, and path changed portions 55*b* may be arranged so as to face each other with a central portion of spiral groove disk 51 being interposed, as shown in FIG. 9, In addition, a length of path changed portion 55*b* and an angle of path changed portion 55*b* with respect to a tangent of spiral path portion 55*a* can be selected as appropriate in order to clean the surface of spherical object 30 uniformly.

Third Embodiment

Next, a third embodiment which is a still another embodiment of the present invention will be described. Basically, a spherical object cleaning system according to the third embodiment has a configuration similar to that of the spherical object cleaning system according to the first or second embodiment described above, and produces an effect similar to that of the spherical object cleaning system according to the first or second embodiment described above. However, the spherical object cleaning system according to the third embodiment is different from the spherical object cleaning systems according to the first and second embodiments described above in terms of the number of placed cleaning apparatuses.

Figure 11:
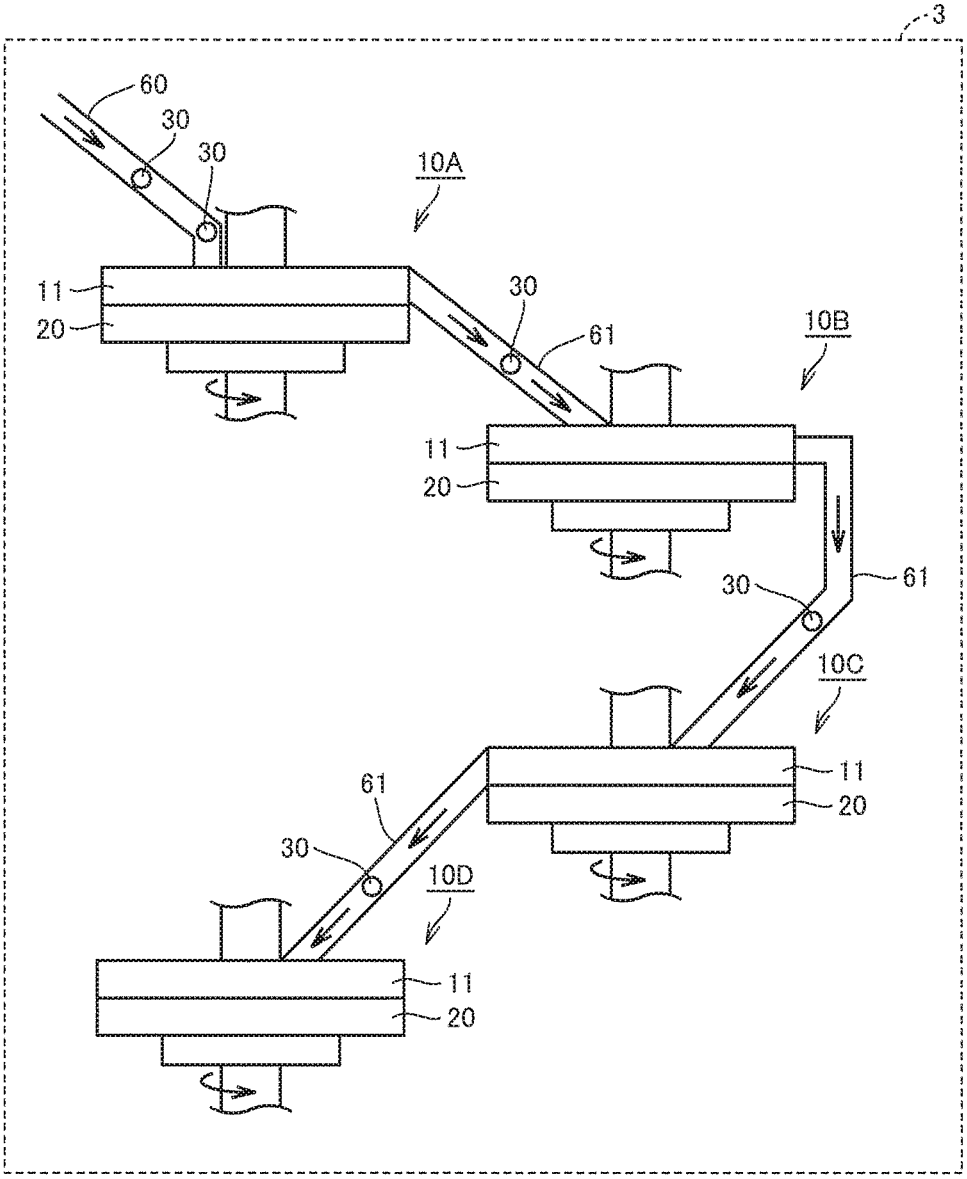
FIG. 11 is a schematic view showing a configuration of a spherical object cleaning system according to a third embodiment of the present invention.

Referring to FIG. 11, a spherical object cleaning system 3 according to the third embodiment includes a plurality of (in FIG. 11, four) cleaning apparatuses 10A, 10B, 10C, and 10D (10A to 10D). Spherical object cleaning system 3 further includes introduction means 60 and transport means 61.

Introduction means 60 is for introducing spherical object 30, which is an object to be cleaned, into cleaning apparatus 10A located on the most upstream side. Transport means 61 is for transporting spherical object 30 cleaned by one of the plurality of cleaning apparatuses 10A to 10D to another cleaning apparatus located on the downstream side of the one of the plurality of cleaning apparatuses 10A to 10D. That is, transport means 61 is provided between cleaning apparatus 10A and cleaning apparatus 10B in order to transport spherical object 30 cleaned by cleaning apparatus 10A to cleaning apparatus 10B, Transport means 61 is also provided between cleaning apparatus 10B and cleaning apparatus 10C in order to transport spherical object 30 cleaned by cleaning apparatus 10B to cleaning apparatus 10C. Transport means 61 is also provided between cleaning apparatus 10C and cleaning apparatus 10D in order to transport spherical object 30 cleaned by cleaning apparatus 10C to cleaning apparatus 10D.

According to spherical object cleaning system 3 in the present embodiment described above, the plurality of cleaning apparatuses 10A to 10D are used, and thus, the uniformity of the degree of cleanliness on the surface of the spherical object can be further improved even when it is difficult to sufficiently clean spherical object 30 by using one cleaning apparatus.

Fourth Embodiment

Next, a fourth embodiment which is a further embodiment of the present invention will be described. Basically, a spherical object cleaning system according to the fourth embodiment has a configuration similar to those of the spherical object cleaning systems according to the first to third embodiments described above, and produces an effect similar to those of the spherical object cleaning systems according to the first to third embodiments described above. However, the spherical object cleaning system according to the fourth embodiment is different from the spherical object cleaning systems according to the first to third embodiments described above in terms of relative positional relation between the first member and the second member.

Figure 12:
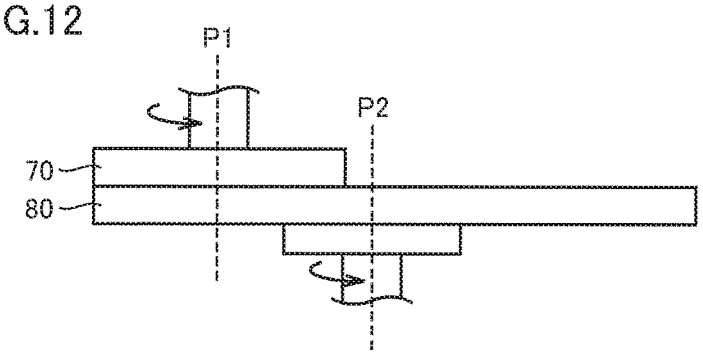
FIG. 12 is a schematic view showing a first example of a configuration of a spherical object cleaning system according to a fourth embodiment of the present invention.

Referring to FIG. 12, in the spherical object cleaning system according to the fourth embodiment, a spiral groove disk 70 as the first member and a flat disk 80 as the second member have rotation axes P1 and P2, respectively, and are configured to be rotatable about rotation axes P1 and P2, respectively. In addition, spiral groove disk 70 and flat disk 80 are arranged such that rotation axes P1 and P2 are eccentric to each other. Specifically, the eccentricity between rotation axis P1 of spiral groove disk 70 and rotation axis P2 of flat disk 80 is greater than a radius of spiral groove disk 70. When an amount of eccentricity is large as described above, spiral groove disk 70 is rotated and flat disk 80 is slowly rotated, and thus, the rotation axis of spherical object 30 can be changed. As a result, according to the spherical object cleaning system in the fourth embodiment described above, the rotation axis of spherical object 30 can be changed due to a difference in circumferential speed when spiral groove disk 70 and flat disk 80 are rotated relatively. As a result, the surface of spherical object 30 can be cleaned further uniformly.

Figure 13:
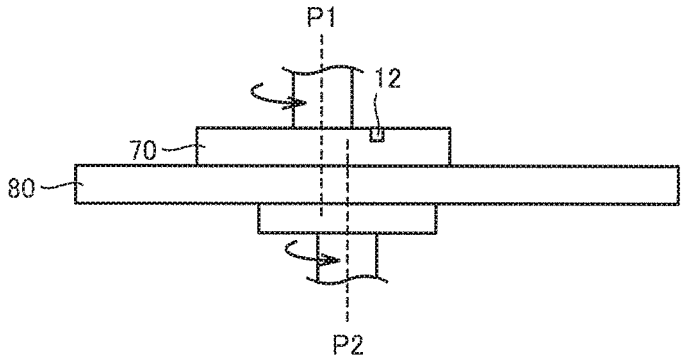
FIG. 13 is a schematic view showing a second example of the configuration of the spherical object cleaning system according to the fourth embodiment of the present invention.

Referring to FIG. 13, the eccentricity between rotation axis P1 of spiral groove disk 70 and rotation axis P2 of flat disk 80 is smaller than a radius of introduction portion 12 of spiral groove disk 70 with respect to rotation axis P1. In this case, spiral groove disk 70 is not rotated and only flat disk 80 is rotated, and thus, the rotation axis of spherical object 30 can be changed.

Fifth Embodiment

Next, a fifth embodiment which is a further embodiment of the present invention will be described. Basically, a spherical object cleaning system according to the fifth embodiment has a configuration similar to those of the spherical object cleaning systems according to the first to fourth embodiments described above, and produces an effect similar to those of the spherical object cleaning systems according to the first to fourth embodiments described above, However, the spherical object cleaning system according to the fifth embodiment is different from the spherical object cleaning systems according to the first to fourth embodiments described above in terms of constituent materials of the first member and the second member.

Figure 14:
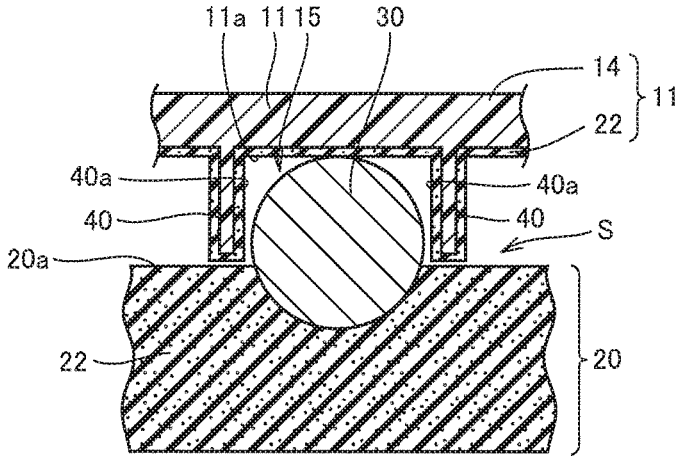
FIG. 14 is a schematic view showing a cross-sectional structure of a portion corresponding to a portion taken along line III-III in FIG. 2 in a spherical object cleaning system according to a fifth embodiment of the present invention.

Referring to FIG. 14, spiral groove disk 11 as the first member in the fifth embodiment is formed by a spiral groove disk base portion 14 including a resin material or a metal material similarly to spiral groove disk 11 (see FIG. 3) in the first embodiment, and porous member 22. In the fifth embodiment as well, the spherical object cleaning system has flat disk 20 as the second member, similarly to the first embodiment.

Spiral groove disk base portion 14 forming spiral groove disk 11 is a portion that serves as a base forming the overall shape of spiral groove disk 11 including the protruding shape of wall portion 40 and the like. It is preferable that spiral groove disk 11 includes a resin material, and more specifically, spiral groove disk 11 is made of, for example, poly vinyl chloride (PVC).

In contrast, porous member 22 forming spiral groove disk 11 is formed like a thin film so as to cover a surface of spiral groove disk base portion 14 on the flat disk 20 side. That is, porous member 22 in spiral groove disk 11 is formed to configure first surface 11*a* facing flat disk 20 and wail surface 40*a* covering wall portion 40 in spiral groove 15.

However, the present invention is not limited to the above-described configuration. Porous member 22 forming spiral groove disk 11 may only be arranged on at least a portion of spiral groove disk 11 with which spherical object 30 comes into contact, i.e., on a portion forming first surface 11*a* and wail surface 40*a* in space S. Conversely, the whole of spiral groove disk 11 including the base portion, i.e., the whole of both spiral groove disk base portion 14 and porous member 22 in FIG. 14 may be formed of porous member 22.

As described above, porous member 22 is arranged such that at least first surface 11*a* and wall surface 40*a* in spiral groove 15 of spiral groove disk 11 are formed of porous member 22. In this respect, the present embodiment is different from the first embodiment in which spiral groove disk 11 does not include porous member 22.

As shown in FIG. 14, in the present embodiment, the whole of flat disk 20 including a portion forming second surface 20*a* which is a surface on the spiral groove disk 11 side is formed of porous member 22. In this respect, the present embodiment is different from the first embodiment having a configuration in which flat disk 20 includes porous member 22 and fibrous member 21 (see FIG. 3) arranged thereon. However, in the present embodiment, porous member 22 may only be arranged so as to form second surface 20*a* at least in a portion of flat disk 20 facing space S, and a portion of flat disk 20 other than the portion forming second surface 20*a* in space S does not necessarily need to be formed of porous member 22.

Although FIG. 14 shows that flat disk 20 is the deformation member similarly to FIG. 3, spiral groove disk 11 provided with spiral groove 15 may be formed as the deformation member in the present embodiment as well.

As described above, in the present embodiment, first surface 11*a* and second surface 20*a* forming space S as well as wall surface 40*a* in space S are formed of porous member 22. In other words, the whole of the inner wall surface of space S (surface with which spherical object 30 arranged in space S may come into contact) is at least formed of porous member 22.

Similarly to the first embodiment, porous member 22 in the present embodiment is an elastic member such as, for example, a sponge. The sponge herein refers to a fibrous sponge made of a synthetic resin or the like. A diameter of pores included in the sponge is preferably equal to or larger than a diameter of a bond with abrasive grains separated from a surface plate or the like for polishing spherical object 30 and adhering to the surface of spherical object 30 after the step of polishing spherical object 30, and is preferably equal to or larger than approximately 0.1 mm, for example. The diameter herein refers to a maximum value of a straight distance from one point of an outer edge of the pore or the bond with abrasive grains through the center of the pore or the bond with abrasive grains to another point of the outer edge of the pore or the bond with abrasive grains. A hardness of the sponge is preferably lower than that of PVC.

Next, the background art of the present embodiment will be described, and then, the function and effect of the present embodiment will be described.

After polishing processing of spherical object 30, the bond with abrasive grains separated from the surface plate or the like used for polishing processing adheres to the surface of spherical object 30. If the surface of spherical object 30 is cleaned by using a spiral cleaning apparatus like cleaning apparatus 10 in order to remove this bond with abrasive grains, the bond with abrasive grains that has adhered to spherical object 30 sticks in the resin material in a site to which spherical object 30 is forwarded. When spiral groove 15 and flat disk 20 are made of iron or resin (such as PVC), the portion in which the bond with abrasive grains has stuck protrudes with respect to the resin material on the surface of spiral groove 15 and the like. When another spherical object 30 passes through this portion, a surface of that spherical object 30 comes into contact with the bond with abrasive grains that has stuck in spiral groove 15 and protruded, and thus, the trouble of formation of a flaw on the surface of spherical object 30 may occur.

Thus, in the present embodiment, space S in which spherical object 30 is arranged, i.e., first surface 11*a* and second surface 20*a* forming the inner wail surface of space S as well as wall surface 40*a* in space S are (entirely) formed of porous member 22 such as a sponge. As a result, in cleaning apparatus 10, the surface of spherical object 30 comes into contact with porous member 22 in the function of spherical object 30 being held and rubbed in space S between spiral groove disk 11 and flat disk 20. Therefore, the bond with abrasive grains that has adhered to the surface of spherical object 30 is taken into, particularly, the pores included in the sponge forming porous member 22. Even if the bond with abrasive grains is not taken into the pores of the sponge, the elasticity of the sponge is low and the surface pressure of the surface that is in contact with spherical object 30 is low. Therefore, the possibility of formation of a flaw on spherical object 30 can be reduced even when spherical object 30 comes into contact with the bond with abrasive grains in the sponge. In addition, the bond with abrasive grains that has not been taken into the pores moves on the surface of the sponge, and thus, can be easily housed in the pores of the sponge. From this point of view as well, the possibility of formation of a flaw on the surface of spherical object 30 caused by the bond with abrasive grains can be reduced.

As described above, in the present embodiment, the bond with abrasive grains that has adhered to the surface of spherical object 30 can be quickly taken into the pores of the sponge as porous member 22, or even if the bond with abrasive grains is not taken into the pores of the sponge, the sponge itself is soft and thus the local surface pressure between spherical object 30 and the bond with abrasive grains at the time of contact between spherical object 30 and the bond with abrasive grains can be reduced. Therefore, the possibility of occurrence of a flaw on the surface of spherical object 30 can be reduced.

By repeating the cleaning process with cleaning apparatus 10 in the present embodiment three times, the bond with abrasive grains on the entire surface of spherical object 30 can be removed and cleaning can be completed.

EXPERIMENTAL EXAMPLE

In order to check the effect of cleaning the surface of the spherical object, the following experiment was performed,

Experimental Example 1

First, a medium-diameter ceramic ball for a machine tool was prepared as a spherical object which is an object to be cleaned. In addition, spherical object cleaning system 1 according to the first embodiment described above was prepared as a spherical object cleaning system. Then, a state of a surface of the above-described ceramic ball after the ceramic ball was cleaned using spherical object cleaning system 1 was checked.

The detailed conditions of the above-described experiment are as shown in Table 1, and a result of the above-described experiment is as shown in Table 2. As is clear from Table 2, it was found that spherical object cleaning system 1 according to the first embodiment described above provides a sufficient degree of cleanliness.

TABLE 1

| | Size of spherical object (inch) | | |
|---|---|---|---|
| | 13/32 | 5/16 | 1/2 |
| Diameter of spiral groove disk (mm) | 200 | 200 | 200 |
| Number of spirals | 5.75 | 5.75 | 4.6 |
| Material of spiral groove disk | poly vinyl chloride | poly vinyl chloride | poly vinyl chloride |
| Material of flat disk | sponge + fabric or sponge | sponge + fabric or sponge | sponge + fabric or sponge |
| Rotation speed of flat disk ($min^{-1}$) | 30 | 30 | 30 |
| Cleaning liquid | white kerosene | white kerosene | white kerosene |
| Number of times of repetition of cleaning | 3 | 2, 3, 4, 5 | 2, 3, 4, 5 |

TABLE 2

| Size of spherical object (inch) | State of sample before cleaning | Number of times of cleaning | Number of samples | Number of cleaning OK | Number of cleaning NG |
|---|---|---|---|---|---|
| 13/32" | water-based coolant drying | 3 | 63 | 63 | 0 |
| 1/2" | water-based coolant drying→oil replacement→white kerosene | 2 | 30 | 29 | 0 |
| | | 3 | 30 | 30 | 0 |
| | | 4 | 30 | 30 | 0 |
| | | 5 | 87 | 87 | 0 |
| | water-based coolant→water rinsing→oil replacement→white kerosene | 2 | 25 | 25 | 0 |
| | | 3 | 25 | 25 | 0 |
| | | 4 | 30 | 30 | 0 |
| | | 5 | 30 | 30 | 0 |
| 5/16" | water-based coolant→water rinsing→oil replacement→white kerosene | 2 | 30 | 30 | 0 |
| | | 3 | 30 | 30 | 0 |
| | | 4 | 30 | 30 | 0 |
| | | 5 | 30 | 30 | 0 |

Experimental Example 2

Similarly to Experimental Example 1 described above, a medium-diameter ceramic ball for a machine tool was prepared. In addition, the spherical object cleaning system according to the second embodiment described above was prepared as a spherical object cleaning system. Then, a state of a surface of the cleaned ceramic ball was checked similarly to Experimental Example 1 described above, The detailed conditions of the above-described experiment are as shown in Table 3. As is clear from Table 3, it was found that the spherical object cleaning system according to the second embodiment described above also provides a sufficient degree of cleanliness,

TABLE 3

| Size of spherical object (inch) | State of sample before cleaning | Number of times of cleaning | Number of samples | Number of cleaning OK | Number of cleaning NG |
|---|---|---|---|---|---|
| 13/32" | water-based coolant drying | 1 | 30 | 30 | 0 |

As a comparative example, a state of a surface of a cleaned spherical object when the spherical object was cleaned by ultrasonic cleaning, brush cleaning and hand-wash cleaning without using the present embodiment was checked. A result is as shown in Table 4. As is clear from Table 4, when the present embodiment is not used, the certain number of cleaning NG samples are seen and a sufficient degree of cleanliness is not obtained.

TABLE 4

| | Time for cleaning 4000 samples | Number of samples | Number of cleaning OK | Number of cleaning NG | Notes |
|---|---|---|---|---|---|
| Ultrasonic cleaning | 120 | 4000 | 50 | 3950 | flaw occurs |
| Brush cleaning | 60 | 4000 | 100 | 3900 | flaw occurs |
| Hand-wash cleaning | 90 | 4000 | 3600 | 400 | |

Whether the cleaning state of the surface of the spherical object described above is "OK" or "NG" is determined by inspection of the entire surface of the spherical object with a laser inspection machine, According to a criterion of determination, cleaning is determined as "NG" when a foreign matter of not less than 50 μm is detected from a resolution of the laser inspection machine, and cleaning is determined as "OK" when such a foreign matter is not detected.

Experimental Example 3

In order to verify the effect of the Fifth embodiment, it was checked whether or not a flaw occurred on a surface of spherical object 30 during cleaning of spherical object 30, using cleaning apparatus 10 configured such that a surface of spiral groove disk 11 in space S was formed of a sponge as in FIG. 14 and cleaning apparatus 10 configured such that a surface of spiral groove disk 11 in space S was formed of a resin. (PVC) as in FIG. 3.

Using each of cleaning apparatus 10 having spiral groove 15 in FIG. 14 and cleaning apparatus 10 having spiral groove 15 in FIG. 3, 6000 spherical objects 30 each having a diameter of 11/32 inches and having diamond abrasive grains adhering to a surface thereof were cleaned, and it was examined whether or not a flaw occurred on the surface. The cleaning process was repeated three times for each spherical object 30 sample. In both cleaning apparatuses 10 described above, a surface of flat disk 20 exposed in space S was formed of a sponge. A result is shown in Table 5 below.

TABLE 5

| Reference figure | Spiral groove disk 11 | Flat disk 20 | Number of samples | Number of flaw-free samples | Number of flaw samples | Flaw occurrence rate (%) |
|---|---|---|---|---|---|---|
| FIG. 3 | PVC | sponge | 6000 | 0 | 6000 | 100% |
| FIG. 14 | sponge | sponge | 6000 | 6000 | 0 | 0% |

As shown in Table 5, flaws were seen in all spherical objects 30 in the case of using spiral groove disk 11 in which PVC was exposed in space S as in FIG. 3, whereas no flaw was seen in all spherical objects 30 in the case of using spiral groove disk 11 in which the sponge was exposed in space S as in FIG. 14.

It should be understood that the embodiments and experimental examples disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The spherical object cleaning system and the method fir cleaning the spherical object according to the present invention may be particularly advantageously applied to a spherical object cleaning system and a method for cleaning a spherical object that require uniform cleaning of a surface of a spherical object.

REFERENCE SIGNS LIST

1, 3 spherical object cleaning system; 10, 10A, 10B, 10C, 10D cleaning apparatus; 11, 16, 51, 70 spiral groove disk; 11*a* first surface; 12, 52 introduction portion; 13, 53 discharge portion; 14 spiral groove disk base portion; 15, 55 spiral groove; 20, 80 flat disk; 20*a* second surface; 21 fibrous member; 22 porous member; 30 spherical object; 40 wall portion; 40*a* wall surface; 55*a* spiral path portion; 55*b* path changed portion; 60 introduction means; 61, transport means; P, P' rotation axis; P1, P2 rotation axis; S space.

The invention claimed is:

1. A cleaning apparatus for cleaning a spherical object, the cleaning apparatus comprising:

a first member having a first surface;

a second member having a second surface facing the first surface, the first surface and the second surface being sandwiching surfaces sandwiching the spherical object, the first surface and the second surface being configured to be rotatable relative to each other;

an introduction portion configured to introduce the spherical object into a space between the first surface and the second surface; and a discharge portion configured to discharge the spherical object from the space, wherein one of the first surface and the second surface is provided with a curve or linear spiral groove configured to guide the spherical object from the introduction portion to the discharge portion along at least one complete spiral turn of the curve or linear spiral groove, and wherein the curve or linear spiral groove includes a portion having a linear path located between portions having a curve or linear spiral path.

2. The cleaning apparatus according to claim 1, wherein one of the first member and the second member is a deformation member configured such that the sandwiching surface can deform from a flat surface to a curved surface conforming to a shape of a surface of the spherical object.

3. The cleaning apparatus according to claim 2, wherein the deformation member includes:

a porous member; and a fibrous member arranged on the porous member, forming the sandwiching surface, and impregnated with a cleaning agent for cleaning the spherical object.

4. The cleaning apparatus according to claim 3, wherein the cleaning agent includes an organic solvent or water.

5. The cleaning apparatus according to claim 1, wherein the curve or linear spiral groove is a region enclosed by the one of the first surface and the second surface and a wall surface of a wall portion protruding from the one of the first surface and the second surface toward the other of the first surface and the second surface, and the first and second surfaces forming the space as well as the wall surface in the space are formed of a porous member.

6. The cleaning apparatus according claim 1, wherein the curve or linear spiral groove is a region enclosed by the one of the first surface and the second surface and a wall surface of a wall portion protruding from the one of the first surface and the second surface toward the other of the first surface and the second surface, and the wall surface is a surface having a friction coefficient higher than that of the one of the first surface and the second surface.

7. The cleaning apparatus according to claim 1, wherein the first member and the second member are arranged such that rotation axes are eccentric to each other.

8. The cleaning apparatus according to claim 1, [a member] wherein one of the first member and the second member, provided with the curve or linear spiral groove, [of the first member and the second member,] includes a resin material or a metal material.

9. A spherical object cleaning system, comprising a cleaning apparatus for cleaning a spherical object, the cleaning apparatus comprising:

a first member having a first surface;

a second member having a second surface facing the first surface, the first surface and the second surface being sandwiching surfaces sandwiching the spherical object, the first surface and the second surface being configured to be rotatable relative to each other:

an introduction portion configured to introduce the spherical object into a space between the first surface and the second surface; and a discharge portion configured to discharge the spherical object from the space, wherein one of the first surface and the second surface is provided with a curve or linear spiral groove configured to guide the spherical object from the introduction portion to the discharge portion along at least one complete spiral turn of the curve or linear spiral groove, and wherein the curve or linear spiral groove includes a portion having a linear path located between portions having a curve or linear spiral path.

10. The spherical object cleaning system according to claim 9, wherein the spherical object cleaning system comprises a plurality of the cleaning apparatuses, and the spherical object cleaning system further comprises transport means configured to transport the spherical object cleaned by one of the plurality of cleaning apparatuses to another cleaning apparatus located on a downstream side of the one of the plurality of cleaning apparatuses.

11. A method for cleaning a spherical object, comprising:

preparing a spherical object;

preparing a cleaning apparatus for cleaning the spherical object;

the cleaning apparatus including:

a first member having a first surface;

a second member having a second surface facing the first surface;

an introduction portion configured to introduce the spherical object into a space between the first surface and the second surface; and a discharge portion configured to discharge the spherical object from the space, one of the first surface and the second surface being provided with a curve or linear spiral groove configured to guide the spherical object from the introduction portion to the discharge portion along at least one complete spiral turn of the curve or linear spiral groove, wherein the curve or linear spiral groove includes a portion having a linear path located between portions having a curve or linear spiral path, introducing the spherical object from the introduction portion into the space;

cleaning the spherical object in the space; and discharging the cleaned spherical object from the discharge portion, in cleaning the spherical object, with the spherical object sandwiched between the first surface and the second surface, the first surface and the second surface being rotated relative to each other, to thereby rotate the spherical object, and the rotating spherical object being guided in the curve or linear spiral groove from the introduction portion to the discharge portion and cleaned.

* * * * *